US005449222A

United States Patent [19]

Titchener et al.

[11] Patent Number: 5,449,222

[45] Date of Patent: Sep. 12, 1995

[54] FOOT SUPPORT FOR RECLINING CHAIR

[76] Inventors: Cal L. Titchener; Dora Titchener, both of 3820 Washakie, Casper, Wyo. 82609

[21] Appl. No.: 320,047

[22] Filed: Oct. 7, 1994

Related U.S. Application Data

[62] Division of Ser. No. 122,130, Sep. 16, 1993, Pat. No. 5,368,367.

[51] Int. Cl.[6] ..... A47C 7/52

[52] U.S. Cl. ..... 297/423.4; 297/423.44; 297/423.46

[58] Field of Search ..... 297/423.1, 423.18, 423.19, 297/423.39, 423.4, 440.1, 423.44, 423.46

[56] References Cited

U.S. PATENT DOCUMENTS

| | | | |
|---|---|---|---|
| 866,316 | 9/1907 | Watson | 297/423.4 |
| 2,823,733 | 2/1958 | Gellin | 297/423.18 |
| 3,672,722 | 6/1972 | Murcott | 297/423.4 X |

*Primary Examiner*—Kenneth J. Dorner
*Assistant Examiner*—Milton Nelson, Jr.
*Attorney, Agent, or Firm*—Dean P. Edmundson

[57] ABSTRACT

A foot support system is described for detachable connection to the leg rest of a reclining chair. The foot support includes a plate which can be attached to the leg rest and then detached when it is not needed. The foot support prevents foot drop and helps to eliminate over-stretching of the flexor muscles and tightening of the extensor muscles.

3 Claims, 2 Drawing Sheets

FOOT SUPPORT FOR RECLINING CHAIR

This is a divisional of application Ser. No. 08/122,130 filed on Sep. 16, 1993, now U.S. Pat. No. 5,368,367.

FIELD OF THE INVENTION

This invention relates to foot supports. More particularly, this invention relates to reclining chairs and foot supports for attachment to such chairs to prevent foot drop and associated problems.

BACKGROUND OF THE INVENTION

Conventional chairs which include a leg rest (e.g., recliner chairs) for supporting the legs of a person in an elevated position do not prevent footdrop, i.e., the situation where the feet of the person extend past the lower edge of the leg rest and hang downwardly. This is extremely undesirable and causes overstretching of the flexor muscles, tightening of the extensor muscles, and can lead to possible contractures.

One of the most challenging problems for a family is to properly position themselves or a family member who is recuperating from surgery or is ill. There are numerous items produced for repositioning a person in bed, e.g., pillows and footboards. There are also hospital-type beds which have the ability to support a person in a variety of different positions. It has been proven, however, that recovery time for a person is shortened if the person is able to get out of bed. This also decreases the probability of pressure sores.

A person who is weak because of surgery or illness must prevent footdrop. In a very short period of time with improper support of the feet while reclining, there is the possibility of overstretching the tibialis anterior (which inverts the foot), extensor hallucis longus (which extends the great toe), extensor digitorum longus (which extends the lateral four toes and eversion of the foot), and the peroneus tertius (which everts the foot). Also affected are the gastrocnemius, soleus, plantaris, and flexor hallucis longus. Once these muscles have been overstretched and been allowed to tighten, ankle movements will be quite difficult or even impossible. If a person is unable to dorsiflex and plantarflex his or her foot, the person will have great difficulty ambulating or may be unable to ambulate at all.

There has not heretofore been provided effective means for preventing footdrop while a person is reclining in a chair.

SUMMARY OF THE PRESENT INVENTION

In accordance with the present invention there is provided a therapeutic foot support for use on a leg rest of a chair (i.e., a reclining chair) to prevent footdrop. The foot support is a very effective therapeutic device to eliminate over-stretching of the plantar flexor muscles and tightening of the dorsi-flexor muscles. The device helps keep the flaccid lower extremity in alignment with the leg and provides an initiatory surface for the high tone lower extremity, thus preventing possible contractures.

In one embodiment, there is provided a foot support for use on a chair having a leg rest. The foot support is detachably connected to the leg rest, and it comprises (a) a plate member; and (b) attachment means for detachably connecting the plate member to the leg rest adjacent the lower edge of the leg rest;

wherein the plate member projects outwardly from the leg rest at an angle preferably perpendicular to the leg rest.

Use of the foot support system of this invention prevents footdrop and helps to eliminate over stretching of the flexor muscles, tightening of the extensor muscles, and prevents possible contractures.

Other advantages of the foot support of the present invention will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
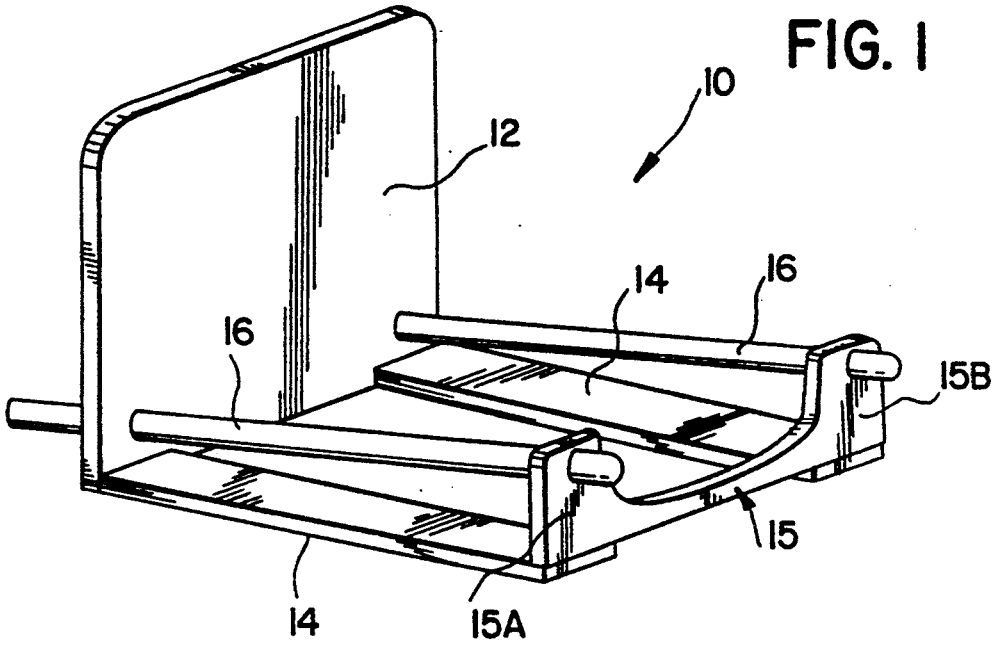
FIG. 1 is a perspective view of one embodiment of foot support of the invention.
Figure 2:
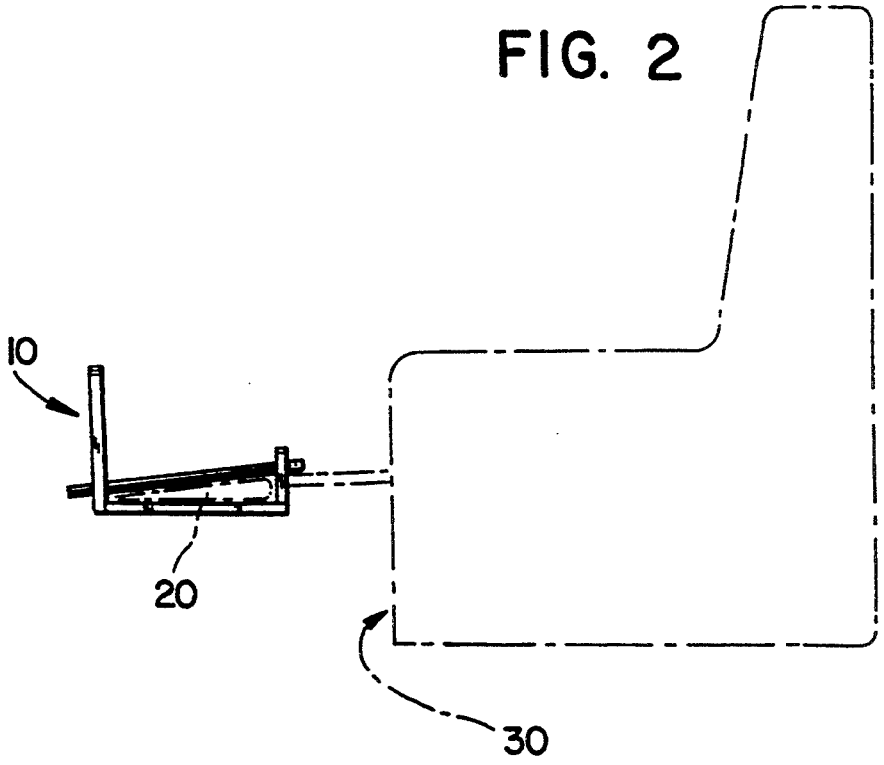
FIG. 2 is a side elevational view illustrating attachment of the foot support of FIG. 1 to the leg rest of a chair.
Figure 3:
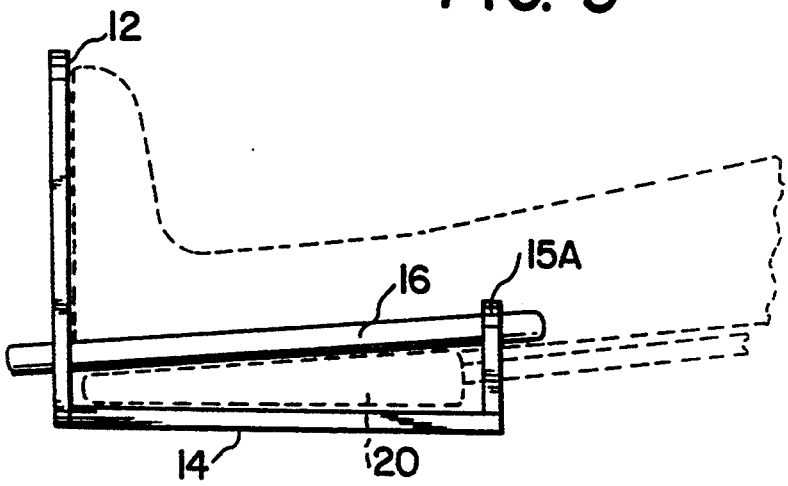
FIG. 3 is a side elevational view illustrating the manner in which the foot support of FIG. 1 prevents foot drop.

In FIGS. 1–3 there is illustrated one embodiment of foot support system 10 of the invention. This embodiment comprises a plate member 12, which is preferably planar, and attachment means for detachably connecting the foot support to the leg rest portion 20 of a conventional chair 30 (e.g., a reclining chair).

In the drawings the attachment means comprises leg members 14 which are secured at one of their ends to the plate member 12 and are preferably generally perpendicular to the plane of plate 12. Member 15 which includes spaced-apart arm members 15A and 15B is secured to the opposite ends of leg members 14. Preferably arms 15A and 15B are generally parallel to plate member 12.

Arms 15A and 15B and plate member 12 include openings therethrough so that elongated rod members 16 can be slidably received through corresponding openings in the arms and the plate member. As shown in FIGS. 2 and 3, the foot support system is detachably connected to leg rest 20 of a conventional chair 30 by capturing the leg rest between rods 16 and leg members 14.

If desired, arms 15A and 15B may be sufficiently tall so that each of such arms may include vertically spaced openings therethrough. This enables the foot support to be attached to foot rests of different thicknesses.

The width and height of the plate member 12 may vary, as desired. Preferably the width is sufficient to nearly span the width of the foot rest of a typical recliner chair.

The plate member, legs, arms and rods may be composed of any suitable material (e.g., wood, metal, fiberglass, plastic, or composite materials).

Figure 4:
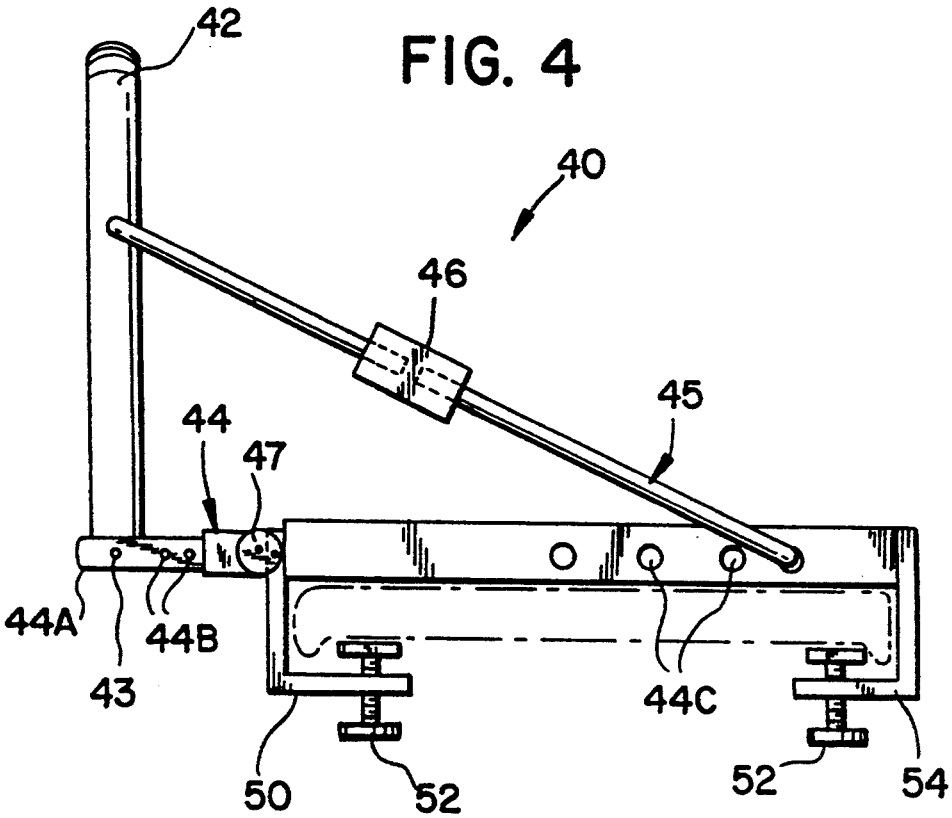
FIG. 4 is a side elevational view of another embodiment of foot support of the invention.

FIG. 4 shows another embodiment of useful foot support 40 of the invention. This system comprises a plate member 42 which is preferably planar. Plate 42 is pivotably attached at its side edges to extension members 44A of spaced apart leg members 44 (one of which is shown in the drawing by means of bolt or pin 43.

Because each extension member 44A includes a plurality of spaced apertures 44B, the position of plate 42 relative to the leg members is adjustable. Spring-loaded pin 47 on each leg 44 secures each extension member 44A to leg 44. By pulling the pin outwardly, the extension member is able to move longitudinally relative to leg 44.

Brace or strut member 45 is connected between plate 42 and leg member 44 to maintain the desired angle between such two members. Turnbuckle 46 is threaded to each end of the strut sections and is rotatable so as to shorten or lengthen strut member 45 to alter the angle, if desired. Leg 44 may also include a plurality of spaced apertures 44C in which one end of strut 45 may be secured. This arrangement also enables the angle of the plate member relative to leg members 44 to be adjusted.

Clamps comprising L-shaped arms 50 and 54 and threaded screws or bolts 52 in such arms are adapted to detachably connect the foot support system to the leg rest of a chair.

The foot supports described herein are adapted to be detachably connected to the foot rest member of a conventional recliner chair. The foot support very effectively prevents footdrop and the problems associated therewith.

Other variants are possible without departing from the scope of the present invention.

What is claimed is:

1. In combination, a chair having a leg rest which includes a lower edge, and a foot support for detachable connection to said leg rest, said foot support comprising:

(a) a plate member having side edges;

(b) attachment means for detachably connecting said plate member to said leg rest adjacent said lower edge of said leg rest; wherein said attachment means comprises (1) a leg member pivotably attached to each of said side edges of said plate member, and (2) clamp means for detachably clamping each said leg member to said leg rest, and (3) brace means connected between said leg member and said plate member;

wherein said plate member projects outwardly from said leg rest at an angle generally perpendicular to said leg rest.

2. A combination in accordance with claim 1, wherein each said leg member includes an extension member including a plurality of spaced apertures, wherein said extension member may be moved longitudinally relative to said leg member and can be secured to said leg member by a pin.

3. A combination in accordance with claim 1, wherein said brace means is adjustable in length.

* * * * *